US005412844A

United States Patent [19]

Horn et al.

[11] Patent Number: 5,412,844

[45] Date of Patent: May 9, 1995

[54] SAWLESS LINT CLEANER

[75] Inventors: James L. Horn, P.O. Box 53785, Lubbock, Tex. 79453; A. Shane Johnson, Lubbock, Tex.

[73] Assignee: James L. Horn, Lubbock, Tex.

[21] Appl. No.: 60,360

[22] Filed: May 11, 1993

[51] Int. Cl.[6] ..... D01B 1/04

[52] U.S. Cl. ..... 19/40; 19/48 R:64.5

[58] Field of Search ..... 19/39, 40, 41, 44, 48 R, 19/55 R, 61, 62 R, 64.5, 200, 202, 203, 204, 205, 85, 95

[56] References Cited

U.S. PATENT DOCUMENTS

| | | | |
|---|---|---|---|
| Re. 31,802 | 1/1985 | Einglett | 19/64.5 |
| 1,056,700 | 3/1913 | Lichtenstein | 19/50 |
| 1,075,304 | 10/1913 | Saunders | 19/50 |
| 2,844,847 | 7/1958 | Smith | 19/205 |
| 3,096,276 | 7/1963 | Franks | 19/200 |
| 3,136,004 | 6/1964 | Smith | 19/95 |
| 4,025,989 | 5/1977 | Naarding et al. | 19/200 |
| 4,154,021 | 5/1979 | Griffith | 19/41 |
| 4,441,232 | 4/1984 | Underbrink | 19/48 |
| 4,458,381 | 9/1984 | Van Doorai | 19/64.5 |
| 4,934,029 | 6/1990 | Wilkes | 19/48 |
| 4,999,881 | 3/1991 | Vandergriff | 19/48 |

FOREIGN PATENT DOCUMENTS

| | | | |
|---|---|---|---|
| 1416541 | 8/1988 | U.S.S.R. | 19/200 |
| 1608256 | 11/1990 | U.S.S.R. | 19/200 |

*Primary Examiner*—Clifford D. Crowder
*Assistant Examiner*—Michael A. Neas
*Attorney, Agent, or Firm*—Wendell Coffee

[57] ABSTRACT

A sawless lint cleaner receives the cotton as doffed from the gin stand in an airstream. The lint is deflected toward spiked cylindrical rollers of a cleaner and wiped across a grating at a speed about equal to the airspeed. The grating is in cylindrical segments as close to the spikes as tolerance will permit. The grating is composed of parallel bars approximately 5 mm thick spaced 13 mm apart and angled about 15° from the radial line of the shaft of the spiked cylinder. Trash passes through the grating. The lint is reunited with the air at the end of the cleaner and conveyed to a condenser. The condenser separates the air and forms the lint into a batt for further cleaning by a typical saw lint cleaner.

18 Claims, 2 Drawing Sheets

SAWLESS LINT CLEANER

CROSS REFERENCE TO RELATED APPLICATION

None, however, Applicant filed Disclosure Document Number 325,404 on Feb. 22, 1993, which document concerns this application; therefore, by separate paper it is respectfully requested that the document be retained and acknowledgment thereof made by the Examiner. (MoPEP 1706)

BACKGROUND OF THE INVENTION (1) Field of the Invention

This invention relates to cotton ginning and more particularly to a lint cleaner in a cotton gin. A cotton ginner is one having ordinary skill in this art.

As used herein, cotton gin refers to the building and all the structure and machinery within the building for receiving harvested seed cotton and separating the seed from the lint, and also removing the trash from the seed and lint.

Seed cotton refers to the cotton as harvested which will include not only the seed with the lint on the seed, but also burrs, sticks and other trash.

Cotton seed is used to refer to the seed with the cotton lint removed therefrom.

Lint is used synonymously with cotton lint and refers to the fibers of cellulose which form the lint and which have been separated from the seed.

The machinery used in the cotton gin is different from the machinery used in cotton mills. The cotton gins are required to handle high volumes of product. The modern cotton gins will process as much or more than 20 bales of cotton per hour. Also, the cotton leaving the cotton gin will not be as smooth and free of twisted fibers, naps, and the like, as is required by the cotton mills for the cotton to be spun into yarn and thread. The cotton gin machinery must first and foremost process cotton quickly. Cotton mills must process cotton so that the lint is in condition to be spun.

(2) Description of the Related Art

The first step in the preparation of cotton is normally done by a cotton gin. At the cotton gin the seed cotton is first cleaned. A common type of cleaner for cleaning the seed cotton as it arrives, is an "air-line cleaner", or an "inclined cleaner". Basically, these terms are different names for the same machine. Basically, in these cleaners, the cotton including burrs, sticks, trash, leaf particles and dirt, are carried along in an airstream. The entire mass of harvested material is wiped across a screen. Originally these screens were formed of a heavy, woven wire. Presently, they are often round bars parallel to a spiked drum which wipes the seed cotton across the screen. The wiping the seed cotton across the screen separates considerable dust, leaf trash, and sticks from the seed cotton and the cotton carried in the airstream. Also, in some of the seed cotton cleaning, the burr is removed. Normally in this step, the locks of seed cotton are snagged upon saw teeth and brought across bars. Often the bars are mounted on cylinders for rotating so that the surface of the saw teeth is moving in an opposite direction from the surface of the bars. In this manner the burrs are knocked free from the locks of seed cotton.

Regardless of the cleaning steps that are involved before the seed cotton is ginned, it is not unusual for it to be cleaned by several cleaning steps.

A gin stand removes the seed from the lint. Normally this is done by snagging the lint upon saw teeth and pulling the lint through spaces between ribs. The spacing of the ribs is too narrow for the seed to pass, and therefore the lint is pulled free of the seed. The cotton lint is doffed from the saw by brushes or air blast. The lint cotton is carried in an airstream.

After the lint has been separated from the seed it customarily is cleaned. For a saw lint cleaner the lint is first separated from the air and formed into a batt. Then, the batt is snagged on the teeth of the lint cleaner and brushed against stationary bars to remove fine leaf particles, and other trash, from the lint. Thereafter the lint was doffed from the saws of the lint cleaner, again condensed and baled into balers.

Often the cotton is passed through two saw lint cleaners. In the saw process of cleaning the lint it is not unusual to form naps or nips, or to crimp and twist the fibers of the cotton, resulting in a rough texture of the cotton, rather than a smooth cotton which is more easily handled by textile mills to spin into yarn to form threads for weaving.

SUMMARY OF THE INVENTION (1) Progressive Contribution to the Art

In an effort to reduce the amount of nips and to produce a smoother cotton after having been lint cleaned, this invention utilizes a sawless lint cleaner.

To a certain extent, the sawless lint cleaner of this invention is closely related in structure to an air-line cleaner or inclined cleaner as used to clean seed cotton.

The sawless lint cleaner receives the lint cotton entrained in an airstream. A deflection valve, somewhat resembling a comb, deflects the lint upon a spiked drum. According to the embodiment of this invention there is a series of four spiked drums inclined upward.

The sawless lint cleaner will be housed in an air-tight housing. The top of the housing is spaced above the top of the drums so that an air plenum is formed there. The lint will be wiped by spiked drums across a grating or screen below the drums. The air will pass through the plenum to the outlet where it is re-combined with the lint which has been brushed across the screen or grating. A grating, as used, is composed of a series of bars having rectangular cross-sections. The bars are about 5 mm in thickness and are spaced from adjacent bars by about 10 mm. The bars are inclined in a forward direction. Good success has been achieved by using this particular arrangement to separate the trash with minimum loss of lint.

After being cleaned by the sawless lint cleaners the cotton moves to a condenser where the air is separated and the lint formed into a batt to be cleaned by a saw lint cleaner.

(2) Objects of this Invention

An object of this invention is to clean lint cotton.

A further object of this invention is to clean lint cotton in high volumes in a cotton gin with a minimum damage to the smooth texture of the lint.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

Figure 1:
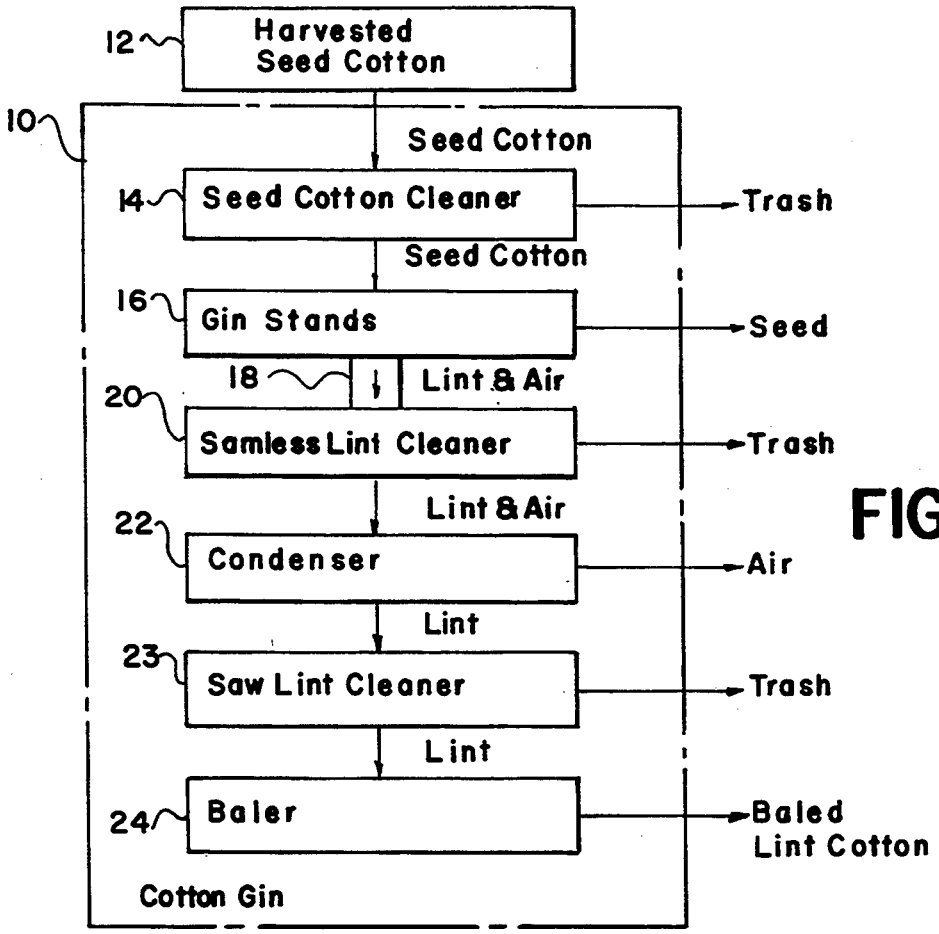
FIG. 1 is a schematic representation of a cotton gin according to this invention.

As an aid to correlating the terms of the claims to the exemplary drawing(s), the following catalog of elements and steps is provided:

10 cotton gin
12 harvested seed cotton
14 seed cotton cleaner
16 gin stands
18 lint duct
20 sawless lint cleaner
22 condenser
23 saw lint cleaner
24 baler
26 inlet
28 spiked drums
30 spiked drums
32 spiked drums
34 spiked drums
36 frame
38 axis
40 grating
42 outlet
44 auger conveyer
46 vacuum dropper
48 trash duct
50 transitional element
52 spikes
54 cylindrical segments
56 series of bars
58 tips
60 working face
62 separator
64 shaft
66 lever
68 tines
70 top
72 plenum
$\alpha$ plane angle
$\beta$ grating angle
W width
L length
T thickness
SS separator space
SW separator width

DESCRIPTION OF THE PREFERRED EMBODIMENTS

Referring to the drawings, in FIG. 1 the dashed lines represents cotton gin 10. Harvested seed cotton 12 will arrive at the cotton gin in trailers or wagons or as modules. In normal operation the harvested seed cotton 12 will be transferred by suction into the gin 10 and into seed cotton cleaner 14. Although the seed cotton cleaner is shown as a separate unit, it will be understood by those in the art that it could be several units which in some cases the cotton would be entrained in air and blown, and in other cases it would be separated from the air and cleaned to remove the burrs and the like. In any event, the cotton seed cleaner will remove trash from the seed cotton and the clean seed cotton will be transferred to gin stands 16.

The gin stands are a battery of machines which separate the seed from the lint. The lint will be transferred by lint duct 18 which receives the lint cotton entrained in air from the gin stand 16 and transfers it to sawless lint cleaner 20. From the sawless lint cleaner the lint, entrained in air, will be taken to condenser 22 where the air is separated from the lint.

The lint will be formed in a batt by condenser 22 and fed to saw lint cleaner 23 where further cleaning takes place. Thereafter the lint is conveyed to baler 24 where the baled lint cotton is then available to be transported to warehouse.

Figure 2:
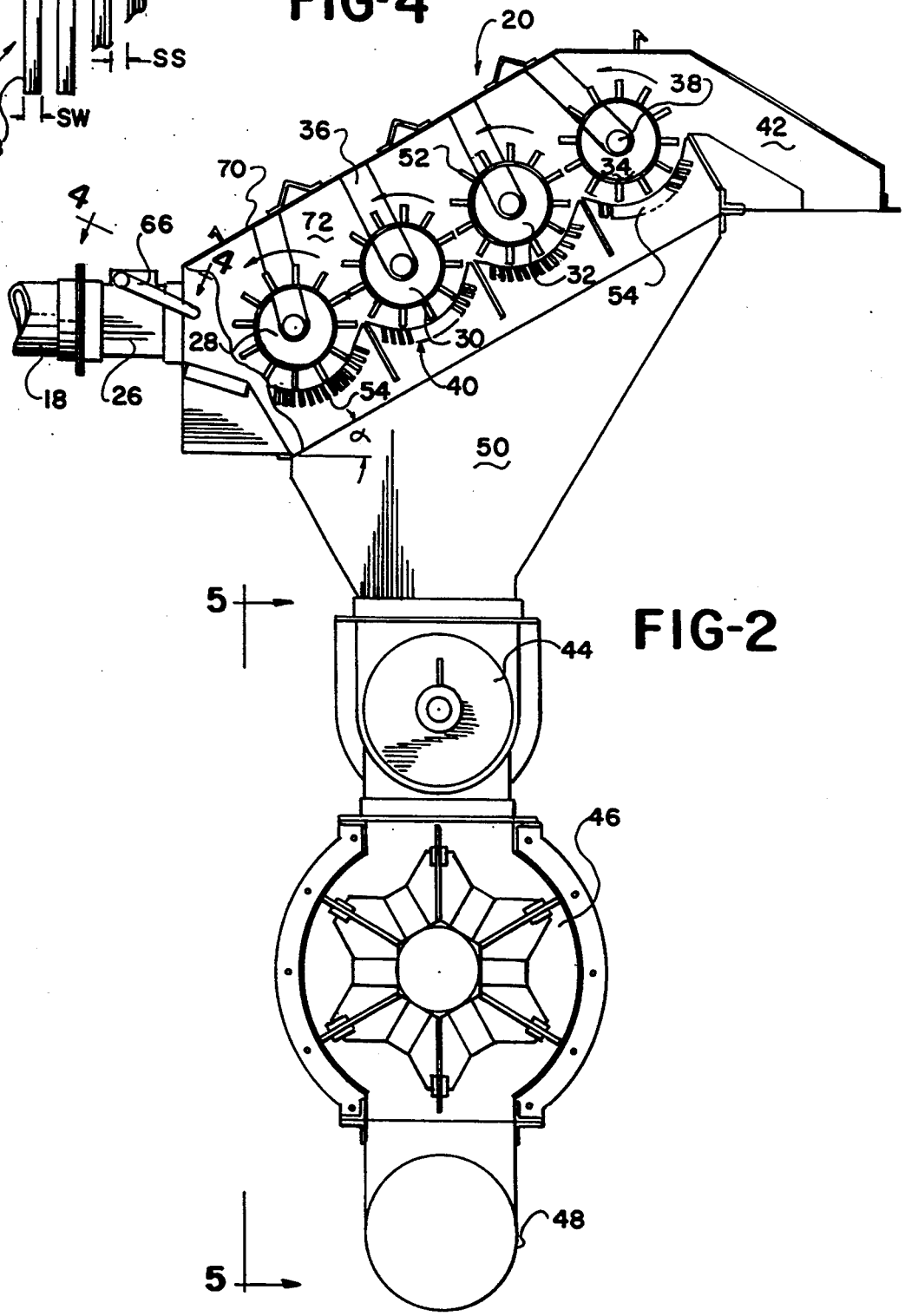
FIG. 2 is a sectional view somewhat schematic of a sawless lint cleaner according to this invention.

Referring to FIG. 2 the sawless lint cleaner 20 is connected to the duct 18 by inlet 26 attached to the lint cleaner 20. The lint cleaner will include a series of spiked drums 28, 30, 32, and 34. Each of the drums will be journalled by suitable bearings to frame 36. The bearings are arranged so that axis 38 of each of the spiked drums lie in a single plane. Also it may be seen that the plane will be at an angle alpha "$\alpha$" to horizontal. I have found that the cleaner works well with alpha equal to 30°. The spiked drums are driven by means not shown in the drawings for clarity and conciseness. The drums 28–34 as viewed in FIG. 2 all rotate in a counterclockwise direction. It will be noted that the lint duct 18 is horizontal as it enters inlet 26 of the sawless lint cleaner 20. Normally, the lint in the airstream will be moving at about 460 meters (1500') per minute. The drive means for the drum is such that the drums are driven with a spike speed of about 460 meters per minute so that the drums with their spikes, move the lint at about the speed at which the cotton is moving in the airstream. Stated otherwise, the drums are connected to a means for rotating the drums at a circumferential speed about equal to the air speed. Thus, it may be seen that the drums 28–34 wipe lint entering from inlet 26 across grating 40. After the lint has been wiped across the grating 40 the lint is swept into outlet 42. At that point the lint will be entrained or reunited in the air and it will be taken from there to the condenser 22 as explained above.

The entire lint cleaner 20 from inlet 26 to outlet 42 is housed in a housing which is reasonably air-tight according to cotton gin standards as is known in the art. The trash which falls through the grating 40 will fall into auger conveyer 44 wherein it is transported to vacuum dropper 46 and the trash dropped to trash duct 48 to be disposed of. The trash will be directed by transitional element 50 from the grating to the conveyor 44.

Each of the spiked drums 28, 30, 32, and 34 will be cylindrical drums about 20 cm (8") in diameter. The length of the drums vary according to the amount of cotton produced, but many would be about 2 m (78") in length. Each of the drums will have spikes 52 projecting from them, the spikes will project from a sheet metal surface of the drum about 1". Each of the spikes 52 will be about 5 mm (3/16") in diameter. The spiked drums are sometimes referred to as spiked cylinders.

The grating 40 will have cylindrical segments 54 for each spiked drum. Each of the segments will be from a series of bars 56. The bars will each have a rectangular cross-section. The bars will have a width "W" of about 13 mm (½") and a thickness "T" of about 5 mm (3/16"). Also, each of the bars will have a length "L" equal to the length of the spiked drums, which is to say about 2 m. The bars will all be parallel to one another and also, they will be parallel to the axis 38 of the spiked drums 28–34. The cylindrical segments 54 will also be co-axial with the spiked drums, i.e., they will each be an arc of the cylinder of which the axis 38 is the center. The bars will be spaced from tips 58 of the spikes 52 with small tolerances. Those having ordinary skill in the cotton ginning arts will understand the clearance needed between spiked drums and gratings associated therewith.

Figure 3:
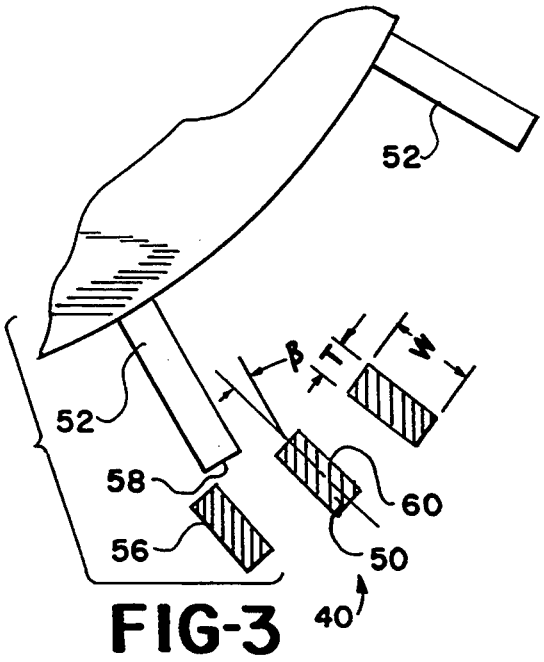
FIG. 3 is a detail of the interaction of the spikes on the spiked drum and the grating.
Figure 5:
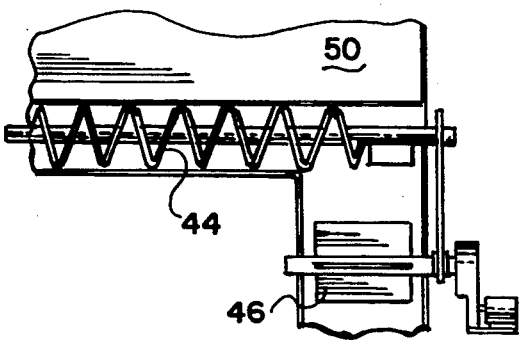
FIG. 5 is a front sectional view of the trash disposal portion of the invention.
Figure 4:
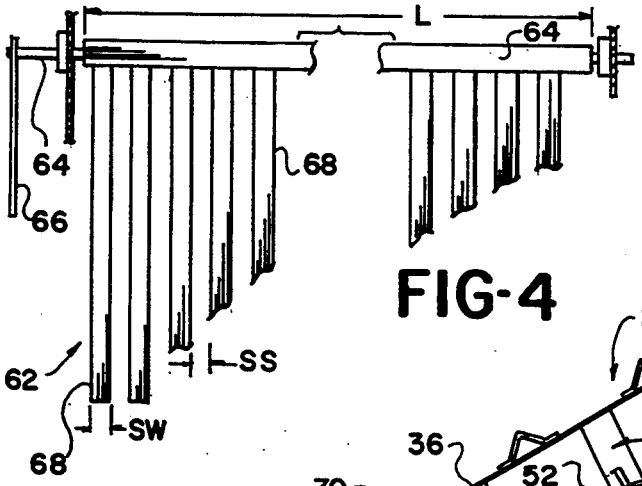
FIG. 4 is a detail of the intake air valve taken substantially on line 4—4 of FIG. 2.

Each of the bars 56 will have what is called a working face 60 which will be that planar face 2 m long and about 13 mm wide. As may be seen in the drawing and particularly in FIG. 3, the bars are not radial from the axis 38 but are angled at an angle beta "$\beta$" therefrom. Good success has resulted from an angle "$\beta$" of about 15°. As may be seen, the angle "$\beta$" is the angle the working face makes with a radial line extending from the axis 38 of the spiked cylinder as measured at the clearance between the spikes and the grating 40. Also it may be seen that the bars are inclined in the direction of travel of the circumference of the spiked drums.

The open spaces between the bars is about 10 mm (⅜"). Stated otherwise, the bars are on about 15 mm centers (9/16").

As stated above, after the lint has been cleaned in the sawless lint cleaner it will be conveyed by the outlet 42 through a duct to condenser 22 and to conventional saw lint cleaner 23.

Air valve or separator 62 is attached to shaft 64 which is journalled through the inlet 26. On the exterior of the inlet 26 lever 66 is attached to shaft 64 so that the separator may be positioned to different angles or positions within the inlet. The separator has a plurality of tines 68 which have a separator width "SW" of about 13 mm (½"). A space between adjacent tines 68 shown on the drawing as separator space "SS" is also about 13 mm (½"). The inlet 26 is rectangular and the entire width of the inlet which would be about 2 m (78") would be the length of the shaft 64 and separator 62. Each of the tines would be about 25 cm (10") in length.

Referring particularly to FIG. 2 it may be seen that in the normal position the separator would be pointing about to the axis of the spiked cylinder 28. By lever 66 it may be varied from horizontal to about 30° downward from horizontal.

The function of the separator or inlet valve is to direct the particles of lint upon the spiked drum 28, and to permit most of the air to go between the top of the spiked drums 28, 30, 32, and 34 and top 70 of the housing of the sawless lint cleaner 20. In this regard the space between the spiked drums and the top 70 is considered to be an air plenum 72.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. The method of cleaning cotton in a cotton gin including the steps of:

a) removing harvested seed cotton into a cotton gin, then b) cleaning the seed cotton, then c) separating the lint from cotton seed in a gin stand, thereafter e) carrying divided particles of lint in an airstream from the gin stand into a sawless lint cleaner, therein f) wiping the divided particles of lint across a grating, g) permitting trash to fall between the elements of the grating, thereafter h) removing the lint cotton and air from the cleaner, and then j) separating the lint from the airstream.

2. The method as defined in claim 1 further comprising:

k) forming the lint into a batt as it is separated from the airstream and further cleaning the lint by a saw lint cleaner.

3. The method as defined in claim 1 further comprising:

k) moving the divided particles of lint in an airstream in a horizontal orientation, l) directing the lint particles to a rotating spiked cylinder to be wiped as defined above, m) permitting the airstream to move above the spiked cylinder, and n) reuniting the divided particles of lint with the airstream as the lint cotton in the airstream are removed from the cleaner as defined above.

4. The method as defined in claim 1 further comprising:

k) forming said grating of parallel rectangular cross-sectioned bars with a spacing between the bars of about 10 mm and the bars being about 5 mm in thickness.

5. The method as defined in claim 1 further comprising:

k) forming said grating of parallel bars having rectangular cross-sections, the rectangular cross-section of the bars being about 13 mm in width.

6. The method as defined in claim 1 further comprising:

k) forming said grating of parallel bars having rectangular cross-sections and the working edges of the bars extending at an angle of about 15° from a radial line of the cylinders and in the direction of the rotation of the cylinders.

7. The method as defined in claim 1 further comprising:

k) forming said grating of parallel bars having i) rectangular cross-sections, ii) the rectangular cross-sections of the bars being about 13 mm in width and about 5 mm in thickness iii) the spacing between said bars being about 10 mm, and iv) working edges of the bar extending at an angle of about 15° from a radial line of the cylinders and in a direction of rotation of the cylinders.

8. The method as defined in claim 1 wherein the lint is wiped at about the same velocity as the airstream velocity.

9. A sawless lint cleaner in a cotton gin having a) suction means for bringing harvested seed cotton into said gin, b) a seed cotton cleaner connected to the suction means, c) gin stands connected to the seed cotton cleaner, and d) a lint duct connected to said gin stands, e) said lint duct forming a means for conducting lint in an airstream from the gin stand;

said sawless lint cleaner comprising in combination with the above:

f) an inlet connected to said lint duct, g) a plurality of spiked drums each mounted for rotation about its axis, h) a grating having a cylindrical segment under each of said spiked drums co-axial therewith, and (h') said sawless lint cleaner housed in an airtight housing with a single outlet for lint and air.

10. The lint cleaner in combination as defined in claim 9 further comprising:

i) the axes of all the rollers are in a single plane, and j) said plane is inclined upward at a 30 degree angle to horizontal.

11. The lint cleaner in combination as defined in claim 9 further comprising:

i) the lint duct being horizontally at the inlet, and j) a deflection valve forming a portion of means for deflecting the lint fibers toward the first roller drum and for permitting the airstream to follow a path above all of the spiked drums.

12. The lint cleaner in combination as defined in claim 9 wherein said grating comprises:

i) a series of bars each having a rectangular cross section, j) said bars parallel to the axis of the spiked drums, k) each bar of the grating having a width of about 13 mm and a thickness of about 5 mm, and l) each of the said bars spaced from the adjacent bars by about 10 mm.

13. The lint cleaner in combination as defined in claim 12 further comprising:

m) each of said bars having the width face or working face angled at about 15° from a radial line extending from the axis, n) said bars inclined in the direction of travel of the circumference of the spiked rollers.

14. The lint cleaner in combination as defined in claim 9 further comprising:

i) each of said bars having the width face or working face angled at about 15° from a radial line extending from the axis, j) said bars inclined in the direction of travel of the circumference of the spiked rollers, k) the axes of all the rollers are in a single plane, l) said plane is inclined upward at a 30 degree angle to horizontal, m) the lint duct being horizontally at the inlet, n) a deflection valve forming a portion of means for deflecting the lint fibers toward the first roller drum and for permitting the airstream to follow a path above all of the spiked drums, o) each bar of the grating having a width of about 13 mm and a thickness of about 5 mm, p) each of the said bars spaced from the adjacent bars by about 10 mm.

15. The lint cleaner in combination as defined in claim 9 further comprising:

i) said lint cleaner having a top, j) an airstream plenum between the rollers and the top of the lint cleaner, k) a deflection valve, l) said deflection valve located within said inlet, m) said deflection valve having a length greater than the height of the inlet, n) said deflection valve having a width equal to the width of the inlet, o) said deflection valve mounted on a shaft, p) said shaft forming a portion of a means for placing the valve between a horizontal position, wherein the valve is at the top of the inlet, to a full deflection position where the valve is angled downward about 30° from the horizontal position.

16. The lint cleaner in combination as defined in claim 9 wherein the airstream has a velocity and further comprising means for rotating the spiked drums attached thereto at a circumferential speed about equal to the air speed.

17. A sawless lint cleaner adapted to be in a cotton gin having a) suction means for bringing harvested seed cotton into said gin, b) a seed cotton cleaner connected to the suction means, c) gin stands connected to the seed cotton cleaner, and d) a lint duct connected to said gin stands, e) said lint duct forming a means for conducting lint in an airstream from the gin stand;

said sawless lint cleaner comprising:

f) an inlet connected to said lint duct, g) a plurality of spiked drums each mounted for rotation about its axis, h) a grating having a cylindrical segment under each of said spiked drums co-axial therewith, i) said lint cleaner having a top, j) an airstream plenum between the rollers and the top of the lint cleaner, k) a deflection valve, l) said deflection valve located within said inlet, m) said deflection valve having a length greater than the height of the inlet, n) said deflection valve having a width equal to the width of the inlet, o) said deflection valve mounted on a shaft, p) said shaft forming a portion of a means for placing the valve between a horizontal position, wherein the valve is at the top of the inlet, to a full deflection position where the valve is angled downward about 30 degrees from the horizontal position, and q) said deflection valve comprised of a series of tines each of which are about ½" (13 mm) in width and are spaced with spacings of 13 mm between tines.

18. The lint cleaner as defined in claim 17 further comprising:

r) each of said bars having the width face or working face angled at about 15° from a radial line extending from the axis, s) said bars inclined in the direction of travel of the circumference of the spiked rollers, t) the axes of all the rollers are in a single plane, u) each bar of the grating having a width of about 13 mm and a thickness of about 5 mm, v) each of the said bars spaced from the adjacent bars by about 10 mm.

* * * *- *